US009597904B2

(12) United States Patent
Rai

(10) Patent No.: US 9,597,904 B2
(45) Date of Patent: Mar. 21, 2017

(54) DROPLETS EJECTING APPARATUS

(71) Applicant: FUJI XEROX CO., LTD., Tokyo (JP)

(72) Inventor: Yoshihira Rai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/790,159

(22) Filed: Jul. 2, 2015

(65) Prior Publication Data

US 2016/0279982 A1 Sep. 29, 2016

(30) Foreign Application Priority Data

Mar. 27, 2015 (JP) ..... 2015-066183

(51) Int. Cl.
*B41J 25/00* (2006.01)
*B41J 2/155* (2006.01)
*B41J 2/21* (2006.01)

(52) U.S. Cl.
CPC ..... *B41J 25/001* (2013.01); *B41J 2/155* (2013.01); *B41J 2/2146* (2013.01)

(58) Field of Classification Search
CPC ..... B41J 2/2135; B41J 25/001
USPC ..... 347/20, 37
See application file for complete search history.

(56) References Cited

U.S. PATENT DOCUMENTS 6,575,557 B2 * 6/2003 Tominaga ..... B41J 2/14024 347/37
6,582,048 B1 * 6/2003 Akahira ..... B41J 2/04505 347/106
2008/0151000 A1 6/2008 Von Essen et al.
2010/0091060 A1 4/2010 Von Essen et al.

FOREIGN PATENT DOCUMENTS

JP 3746730 12/2005
JP 2010-514589 5/2010

OTHER PUBLICATIONS

Abstract and machine translation of JP 3746730.

* cited by examiner

*Primary Examiner* — Jason Uhlenhake
(74) *Attorney, Agent, or Firm* — Fildes & Outland, P.C.

(57) ABSTRACT

A droplets ejecting apparatus includes: an ejection head that ejects droplets to a predetermined ejection direction toward a recording medium being fed in a predetermined feeding direction; a support unit that supports the ejection head; moving members that are provided for a first-side portion and a second-side portion between which an ejection region of the ejection head is interposed in the feeding direction in a view as viewed in the ejection direction, and that move the first-side portion and the second-side portion in a crossing direction that is perpendicular to the ejection direction and the feeding direction; and a control unit as defined herein.

9 Claims, 12 Drawing Sheets

DROPLETS EJECTING APPARATUS

CROSS-REFERENCE TO RELATED APPLICATIONS

This application is based on and claims priority under 35 USC 119 from Japanese Patent Application Ho. 2015-066183 filed on Mar. 27, 2015.

BACKGROUND

Technical Field

The present invention relates to a droplets ejecting apparatus.

SUMMARY

According to an aspect of the invention, there is provided a droplets ejecting apparatus comprising: an ejection head that ejects droplets to a predetermined ejection direction toward a recording medium being fed in a predetermined feeding direction; a support unit that supports the ejection head; moving members that are provided for a first-side portion and a second-side portion between which art ejection region of the ejection head is interposed in the feeding direction in a view as viewed in the ejection direction, and that move the first-side portion and the second-side portion in a crossing direction that is perpendicular to the ejection direction and the feeding direction; and a control unit that causes the ejection head to move in the crossing direction relative to the support unit by controlling the moving members so as to move the first-side portion and the second-side portion toward the same side in the crossing direction, and causes the ejection head to rotate relative to the support unit about an axis extending in the ejection direction by controlling the moving members so as to move the first-side portion and the second-side portion toward opposite sides in the crossing direction.

DESCRIPTION OF SYMBOLS

10: Image forming apparatus (example droplets ejecting apparatus)
11: Control unit
23: Support unit
30: Unit head (example ejection head)
68: Linear actuator (example moving member)
70: Top frame (example first fixing member)
90: Bottom frame (example second fixing member)

DETAILED DESCRIPTION

An exemplary embodiment of the present invention will be hereinafter described with reference to the drawings.

(Image Forming Apparatus 10)

Figure 1:
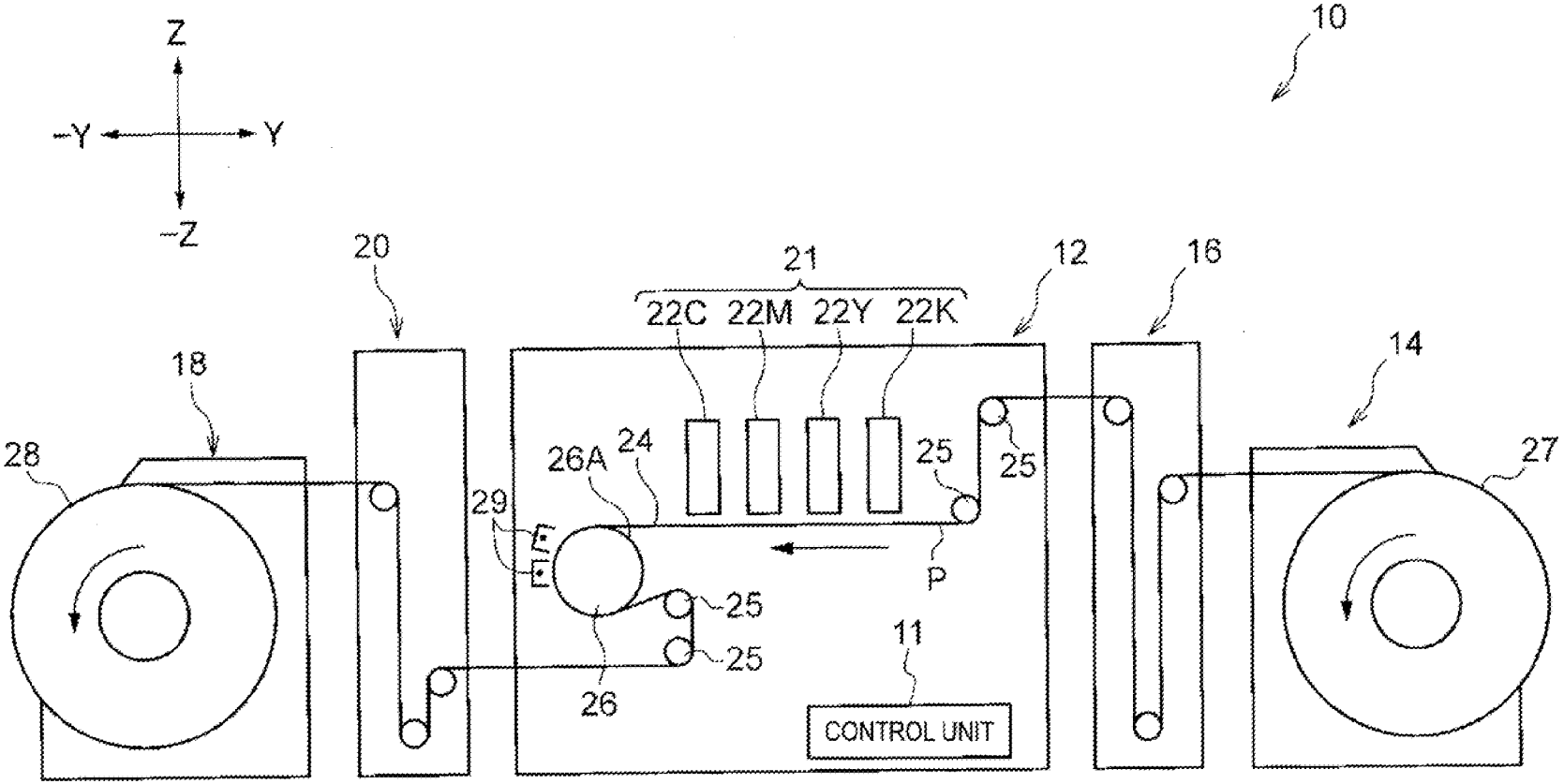
FIG. 1 is a schematic diagram showing the configuration of an image forming apparatus according to an exemplary embodiment.

An image forming apparatus 10 (example droplets ejecting apparatus) will be described below. FIG. 1 is a schematic diagram showing the configuration of the image forming apparatus 10. The X, −X, Y, −Y, Z, and −Z directions that will be used in the following description are shown in the drawings by arrows. The set of X and −X directions, the set of Y and −Y directions, and the set of Z and −Z directions cross each other (more specifically, they are perpendicular to each other). The Z direction is the upward direction, and the −Z direction is the downward direction and is also an ejection direction (described later). The −Y direction is a feeding direct ion of a continuous sheet P (described later). The X and −X directions correspond to a width direction of the continuous sheet P which crosses its feeding direction.

As shown in FIG. 1, the image forming apparatus 10 is equipped with an image forming unit 12 for forming an image on a continuous sheet P (example recording medium), a preprocessing unit 14 which houses the continuous sheet P a part of which is to be supplied to the image forming unit 12, and a buffer unit 16 which is disposed between the image forming unit 12 and the preprocessing unit 14 and adjusts the feeding rate etc. of a part of the continuous sheet P that is supplied from the preprocessing unit 14 to the image forming unit 12.

The image forming apparatus 10 is also equipped with a post-processing unit 18 which houses a part of the continuous sheet P that has been ejected from the image forming unit 12 and a buffer unit 20 which is disposed between the image forming unit 12 and the post-processing unit 18 and adjusts the feeding rate etc. of a part of the continuous sheet P that is output from the image forming unit 12 to the post-processing unit 18.

The image forming unit 12 is equipped with plural rolls 25 for guiding a part of the continuous sheet P along a feeding path 24 of the continuous sheet P and a droplets ejecting mechanism 21 (image forming unit) for forming an image on a part of the continuous sheet P being fed in the predetermined feeding direction (−Y direction) along the feeding path 24 by ejecting droplets toward it.

The droplets ejecting mechanism 21 is equipped with droplets ejection heads 22K, 22Y, 22M, and 22C for ejecting ink droplets (example droplets) of respective colors, that is, black (K), yellow (Y), magenta (M), and cyan (C), toward the continuous sheet P.

The droplets ejection heads 22K, 22Y, 22M, and 22C are arranged in this order downstream in the feeding direction of the continuous sheet P (hereinafter may be referred to simply as a sheet feeding direction) so as to be opposed to a part of the continuous sheet P.

In the following description, the suffixes K, Y, M, and C that are attached to the symbol "22" will be omitted if it is not necessary to discriminate between the colors K, Y, M, and C. A specific configuration of each droplets ejection head 22 will be described later.

Disposed downstream of the droplets ejection head 22C in the sheet feeding direction is a drying drum 26 for drying of an image formed on a part of the continuous sheet P. A part of the continuous sheet P being fed is wound on an outer circumferential surface of the drying drum 26, and the drying drum 26 is kept in contact with the back surface of the part of the continuous sheet P and thereby makes a follower rotation.

Halogen heaters 29 are disposed around the drying dross 26 which dry an image formed on a part of the continuous sheet P wound on the drying drum 26.

The image forming unit 12 is further equipped with a control unit 11 for controlling the operations (driving) of the individual units.

The preprocessing unit 14 is equipped with a supply roll 27 on which the continuous sheet P is wounded a part of which is to be supplied to the image forming unit 12. The supply roil 27 is supported rotatably by a frame member (not shown).

The post-processing unit 18 is equipped with a take-up roll 28 (part of a feeding mechanism) for taking up a part of the continuous sheet P on which images have been formed. The take-up roll 28 is rotated receiving rotational power from a motor (not shown), whereby a part of the continuous sheet P is given tension in the sheet feeding direction and fed along the feeding path 24, Ink droplets (droplets) of the individual colors are ejected from the droplets ejection heads 22 toward a part of the continuous sheet P being fed, whereby an image is formed on it.

(Droplets Ejection Heads 22)

Figure 2:
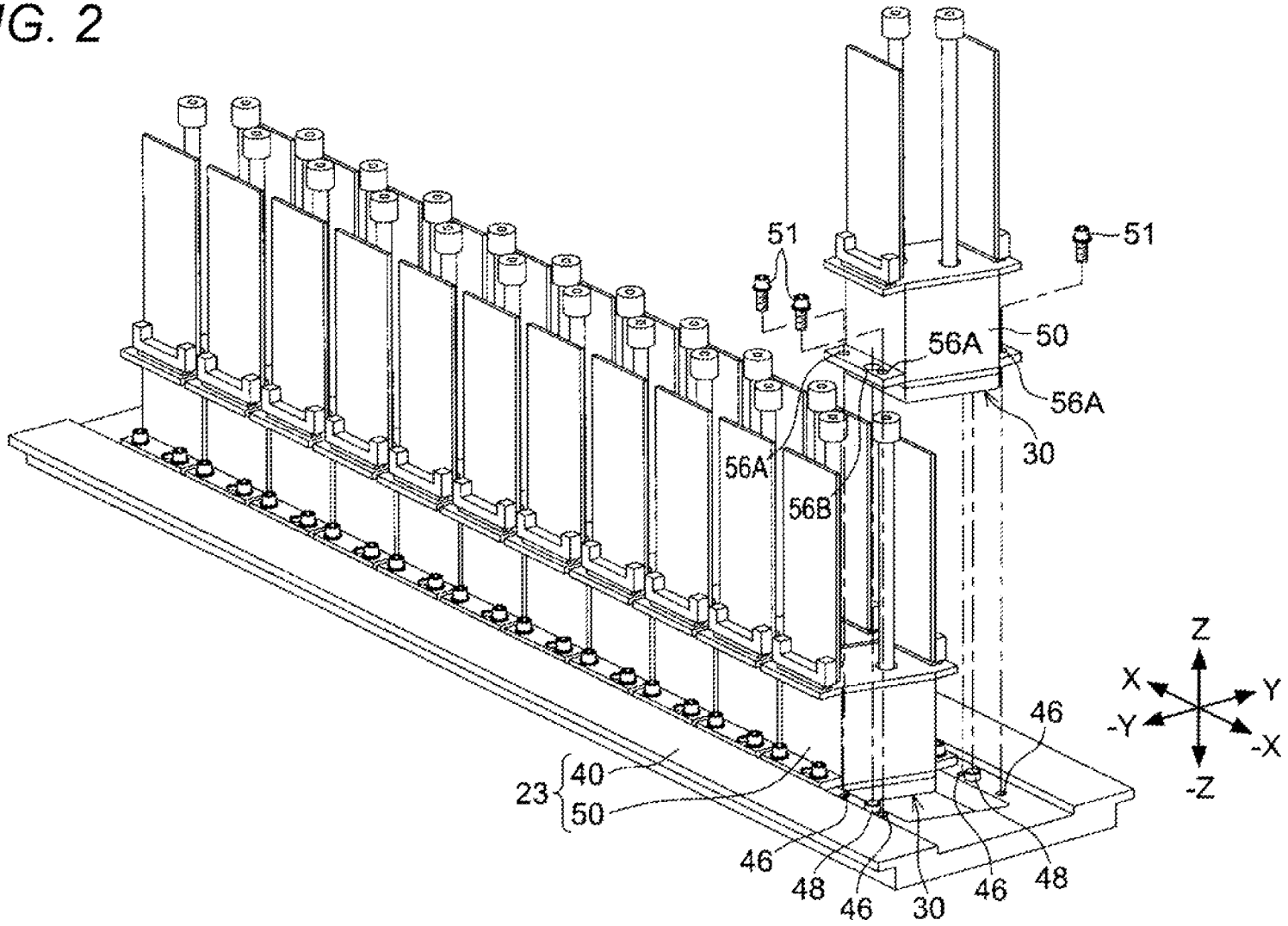
FIG. 2 is a perspective view showing the configuration of each droplets ejection head employed in the exemplary embodiment.

The configuration of each droplets ejection head 22 will be described below. FIG. 2 is a perspective view showing the configuration of each droplets ejection head 22.

As shown in FIG. 2, each droplets ejection head 22 has plural unit heads 30 (example ejection heads) for ejecting ink droplets in the predetermined ejection direction (−Z direction) and a support unit 23 which supports the plural unit heads 30.

The plural unit heads 30 are arranged in series in the width direction of the continuous sheet P (X direction). That is, the unit heads 30 are arranged linearly, rather than in a staggered manner, in the width direction of the continuous sheet P.

Since the plural unit heads 30 are arranged in the width direction of the continuous sheet P (X direction), the droplets ejection head 22 is made a long head that is longer than the maximum width of the continuous sheet P.

The droplets ejection head 22 also has moving mechanisms 60 (see FIG. 8) each of which moves the associated unit head 30 in the width direction of the continuous sheet P (X direction) relative to the support unit 23 and rotate the associated unit head 30 relative to the support unit 23 about the axis extending in the ejection direction (−Z direction). Specific structures of the support unit 23, each unit head 30, and each moving mechanism 60 will be described.

(Support Unit 23)

As shown in FIG. 2, the support unit 23 has plural bodies 50 which are fixed to the respective unit heads 30 and a support member 40 which supports the unit heads 30 via the respective bodies 50.

(Support Member 40)

Figure 3:
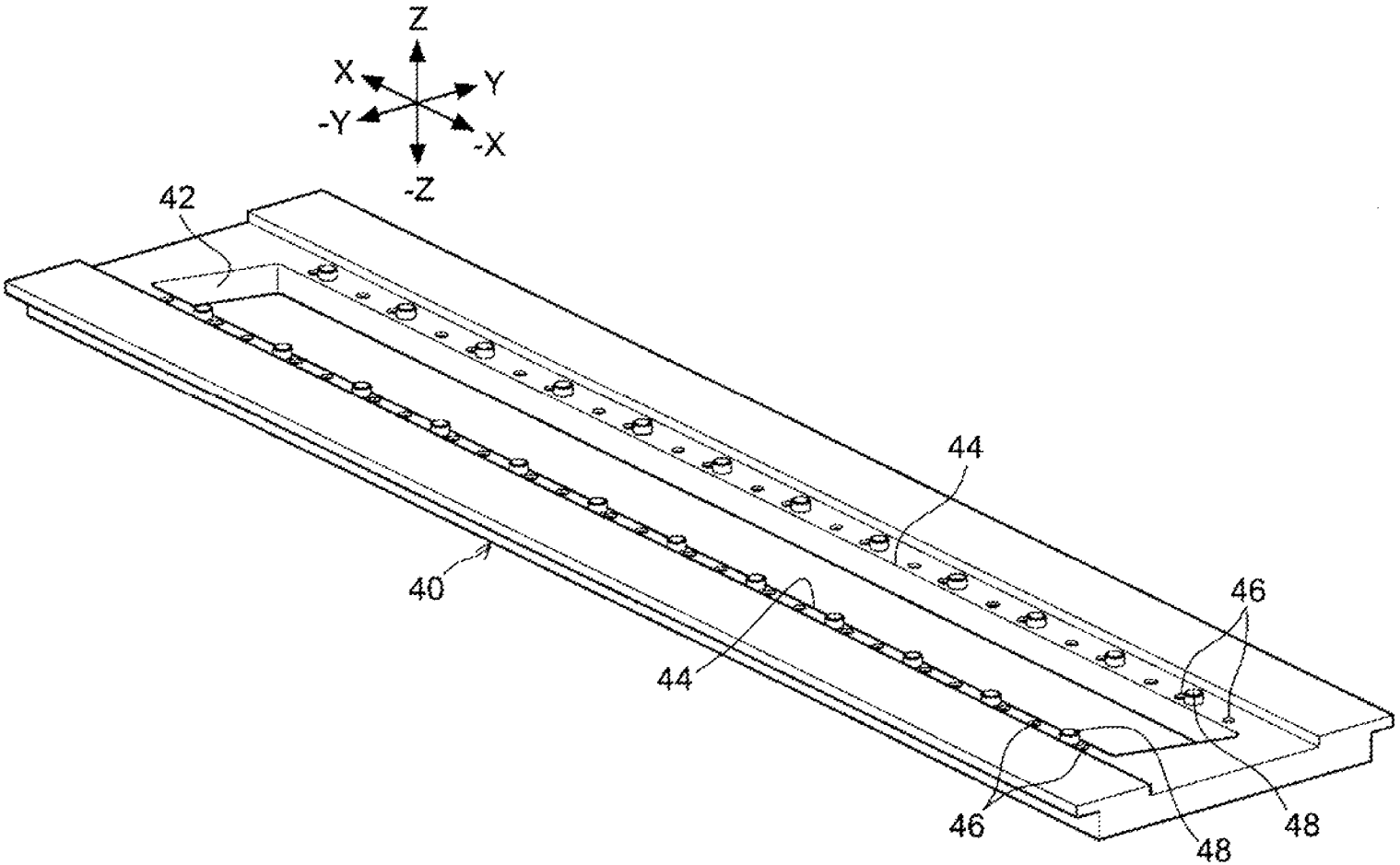
FIG. 3 is a perspective view of a support member employed in the exemplary embodiment.

As shown in FIG. 3, the support member 40 is shaped like a plate that is thick in the vertical direction (Z direction). In a plan view, the support member 40 is shaped like a rectangle that is long in the width direction of the continuous sheet P (X direction). An opening 42 that is shaped like a parallelogram (long in the width direction of the continuous sheet P (X direction)) in a plan view is formed through the support member 40, whereby the support member 40 is shaped like a frame having a rectangular outer rim.

The top surface of the support member 40 is formed with plural (e.g., 12) pairs of screw holes 46 into which respective screws 51 (see FIG. 2) are screwed, alongside each of Y-side and −Y-side edges 44 of the opening 42. A positioning pin 48 for positioning the associated body 50 with respect to the support member 40 projects upward between each pair of screw holes 46.

(Body 50)

Figure 4:
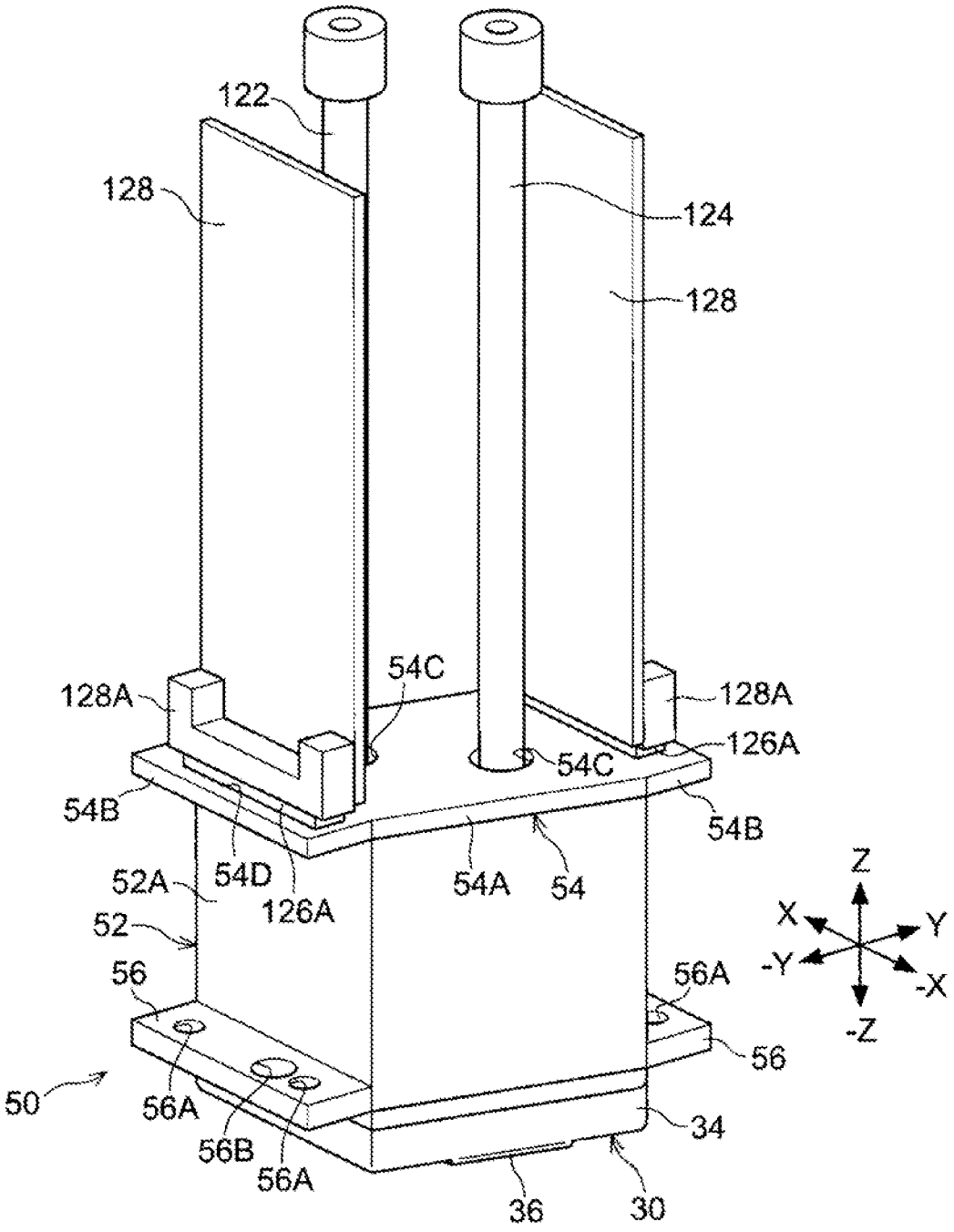
FIG. 4 is a perspective view of each unit head and a body associated with it.
Figure 5:
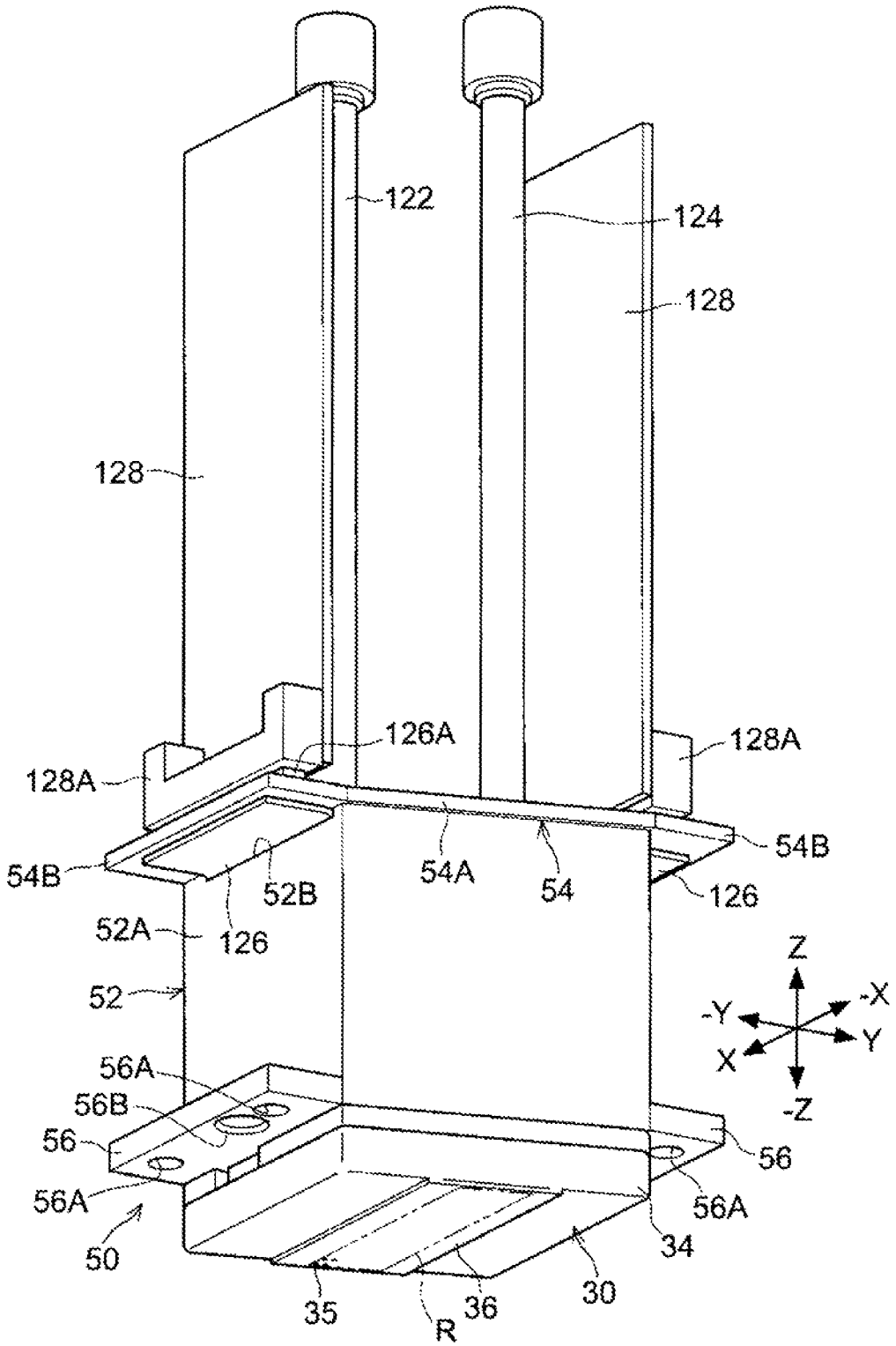
FIG. 5 is another perspective view of each unit head and a body associated with it.

As shown in FIGS. 4 and 5, each body 50 has a quadrangular cylinder 52 which is shaped like a parallelogram in a plan view, a top plate 54, and brims 56 which project from a bottom portion of the quadrangular cylinder 52 in the Y and −Y directions, respectively.

As shown in FIG. 5, slits 52B through which wiring members 126 that connect the unit head 30 to respective circuit boards 128 are inserted are formed through respective side wails 52A (i.e., downstream end walls in the Y and −Y directions) of the quadrangular cylinder 52 at their top portions, respectively.

As shown in FIG. 4, the fop plate 54 is shaped like a plate that is thick in the vertical direction (Z direction). More specifically, the top plate 54 has a closing portion 54A which closes the top opening of the quadrangular cylinder 32 and brims 54B which project from the closing portion 54A in the Y and −Y directions, respectively. In a plan view, the closing portion 54A has a parallelogram shape that is similar to the parallelogram shape of the quadrangular cylinder 52. Two holes 54C through which a supply pipe 122 and a communication pipe 124 (described later) are inserted, respectively, are formed through the closing portion 54A. insertion holes 54D through which connectors 126A of the wiring members 126 are inserted are formed through the brims 54B, respectively.

A pair of holes 56A in which screws 51 (see FIG. 2) that are screwed into the pair of screw holes 46 of the support member 40 are inserted, respectively, are formed through each brim 56 of the body 50. An insertion hole 56B through which a positioning pin 48 of the support member 40 is inserted is formed between the pair of holes 56A.

As shown in FIG. 2, each body 50 is fixed to the support member 40 in such a manner that the associated positioning pins 48 of the support member 40 are inserted into the respective insertion holes 56B to position the body 50 with respect to the support member 40 and then screws 51 are screwed into the respective screw holes 46.

(Unit Head 30)

Figure 6:
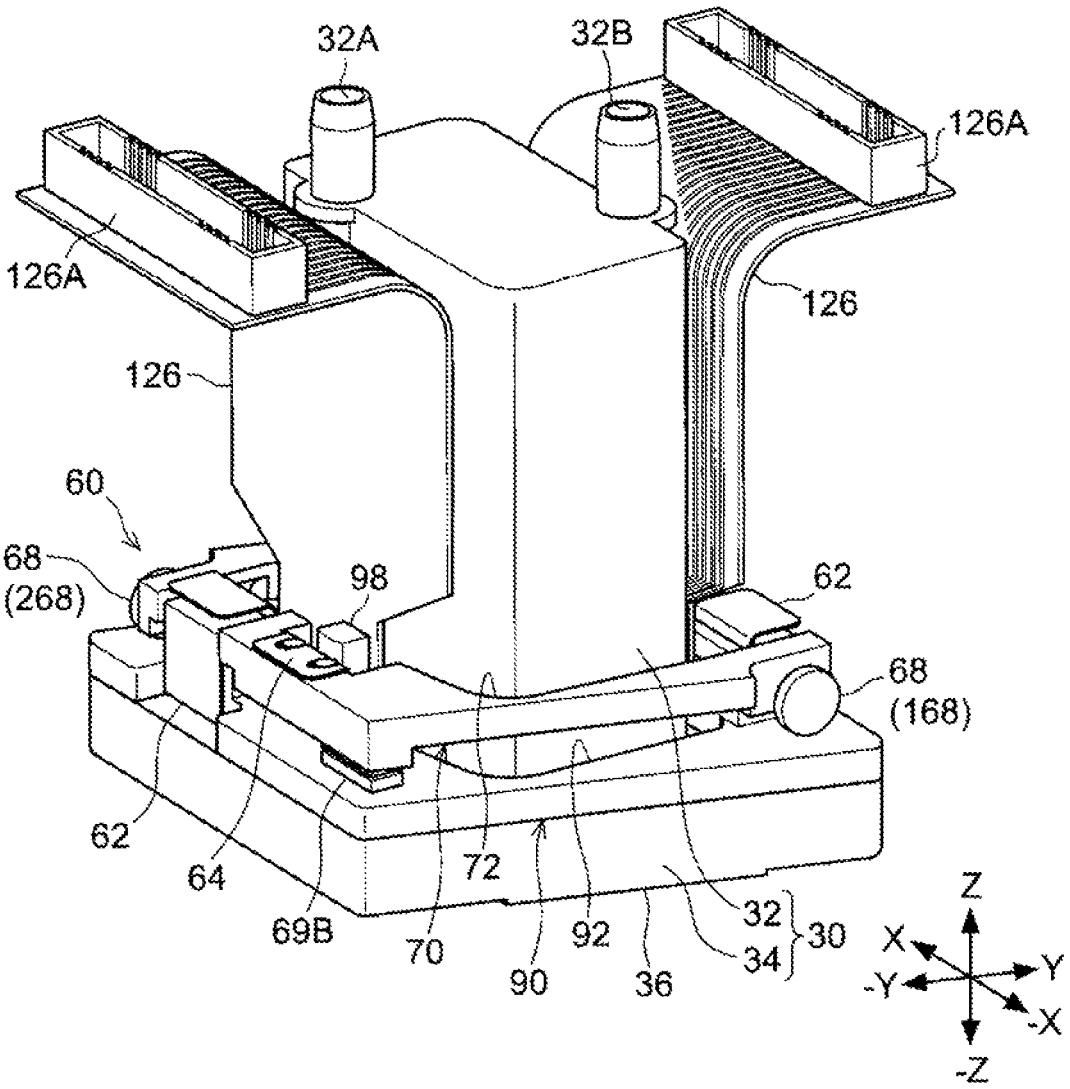
FIG. 6 is a perspective view showing the structures of each unit head and a moving mechanism associated with it.

Each unit head 30 (example ejection head) is an ejection head for ejecting ink droplets in the predetermined ejection direction (−Z direction) toward a part of the continuous sheet P being fed in the predetermined feeding direction (−Y direction). More specifically, as shown in FIG. 6, each unit head 30 has a storage unit 32 for storing ink temporarily and an ejection unit 34 for ejecting, as ink droplets, part of ink stored in the storage unit 32.

An inlet 32A through which ink is to flow into the storage unit 32 and an outlet 32S through which ink is to flow out of the storage unit 32 are formed at the top of the storage unit 32.

The supply pipe 122 (see FIG. 4) for supplying ink from an ink tank (not shown) to the storage unit 32 is connected to the inlet 32A, and the communication pipe 124 (see FIG. A) for returning ink from the storage unit 32 to the ink tank is connected to the outlet 32B. The supply pipe 122 and the communication pipe 124 allow ink to circulate along the closed path including the ink tank and the unit head 30.

Figure 7:
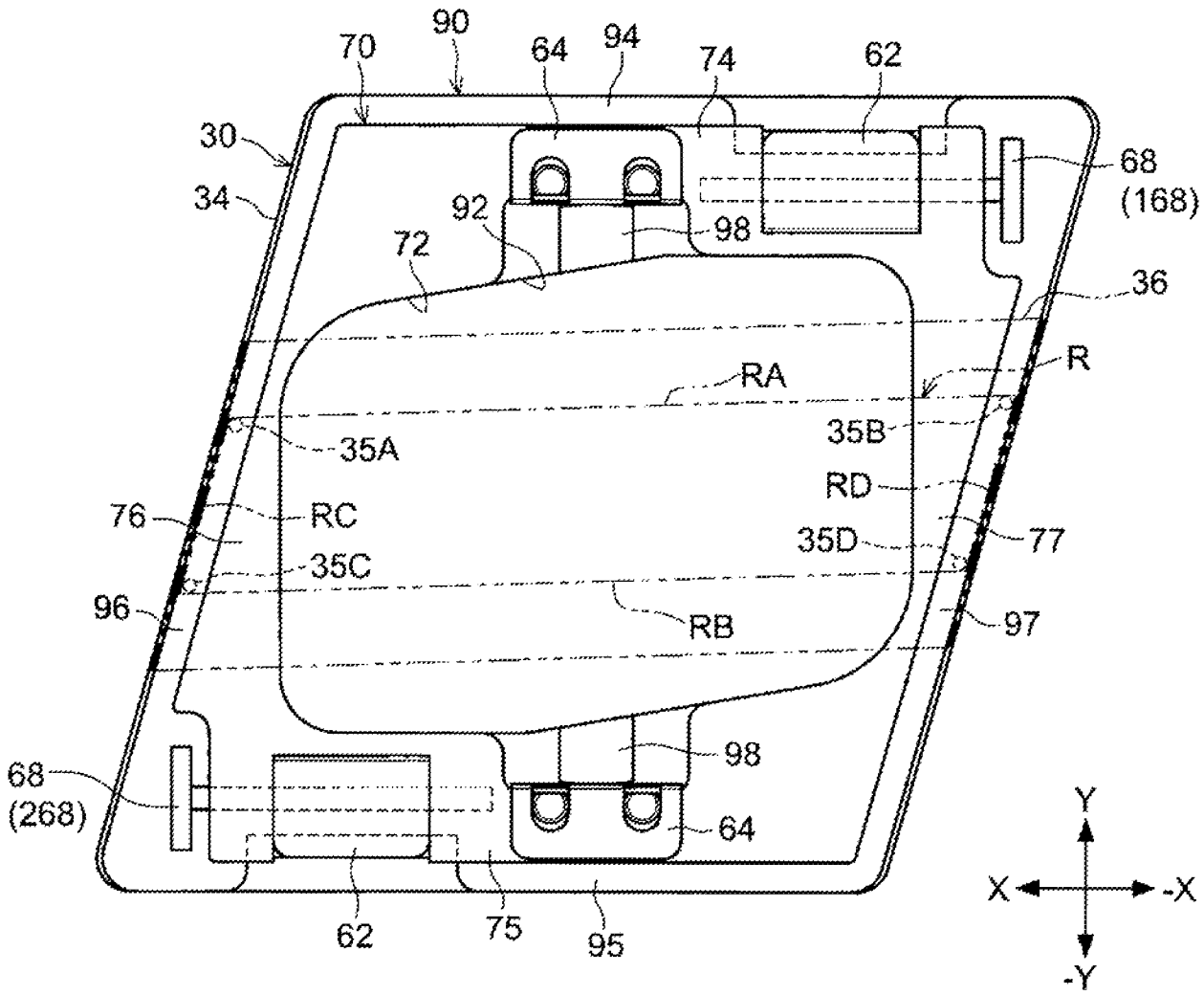
FIG. 7 is a plan view showing the structures of each unit head and the moving mechanism associated with it.

As shown in FIG. 5, for example, the ejection unit 34 has plural plates (not shown) including a nozzle plate 36 in which plural nozzles 35 are formed and a drive unit (not shown) which consists of, for example, piezoelectric elements. The plural plates are laid one on another and ink flow passages are formed by holes that penetrate through the plural plates and spaces between the plural plates. The drive unit is driven, as ink flows through these flow passages, whereby ink is ejected from the plural nozzles 35 in the form of ink droplets. The drive unit is connected to the circuit boards 128 (see FIG. 5) having drive circuits via the wiring members 126 (see FIG. 6) which are flexible wiring boards or the like, respectively. As shown in FIG. 5, the wiring members 126 are electrically connected to the respective circuit boards 128 in such a manner that the connectors 126A of the wiring members 126 are connected to connectors 128A of the circuit boards 128, respectively. As shown in FIG. 7, the ejection unit 34 is shaped approximately like a parallelogram in a plan view.

In the nozzle plate 36 of the ejection unit 34 of each unit head 30, a region in which the nozzles 35 are formed is an election region R (see FIG. 7) from which ink droplets are ejected. More specifically, as shown in FIG. 7, the ejection region R is, for example, a region that is defined by lines RA, RB, RC, and RD.

The line RA is a line that, extends in the X direction and is in contact with, on the destination side in the Y direction, the outer surface of a most downstream nozzle 35A in both of the Y and X directions and the outer surface of a most downstream nozzle 35B in both of the Y and −X directions among the plural nozzles 35.

The line RB is a line that extends in the X direction and is in contact with, on the destination side in the −Y direction, the outer surface of a most downstream nozzle 35C in both of the −Y and X directions and the outer surface of a most downstream nozzle 3SD in both of the −Y and −X directions among the plural nozzles 35.

The line RC is a line that is in contact with the outer surfaces of the nozzles 35A and 35C on the destination side in the X direction. The line RD is a line that is in contact with the outer surfaces of the nozzles 358 and 35D on the destination side in the −X direction. In FIG. 1, for the convenience of description, the nozzles 35A-35D are drawn as if to have a larger diameter than the actual ones.

(Moving Mechanism 60)

Figure 8:
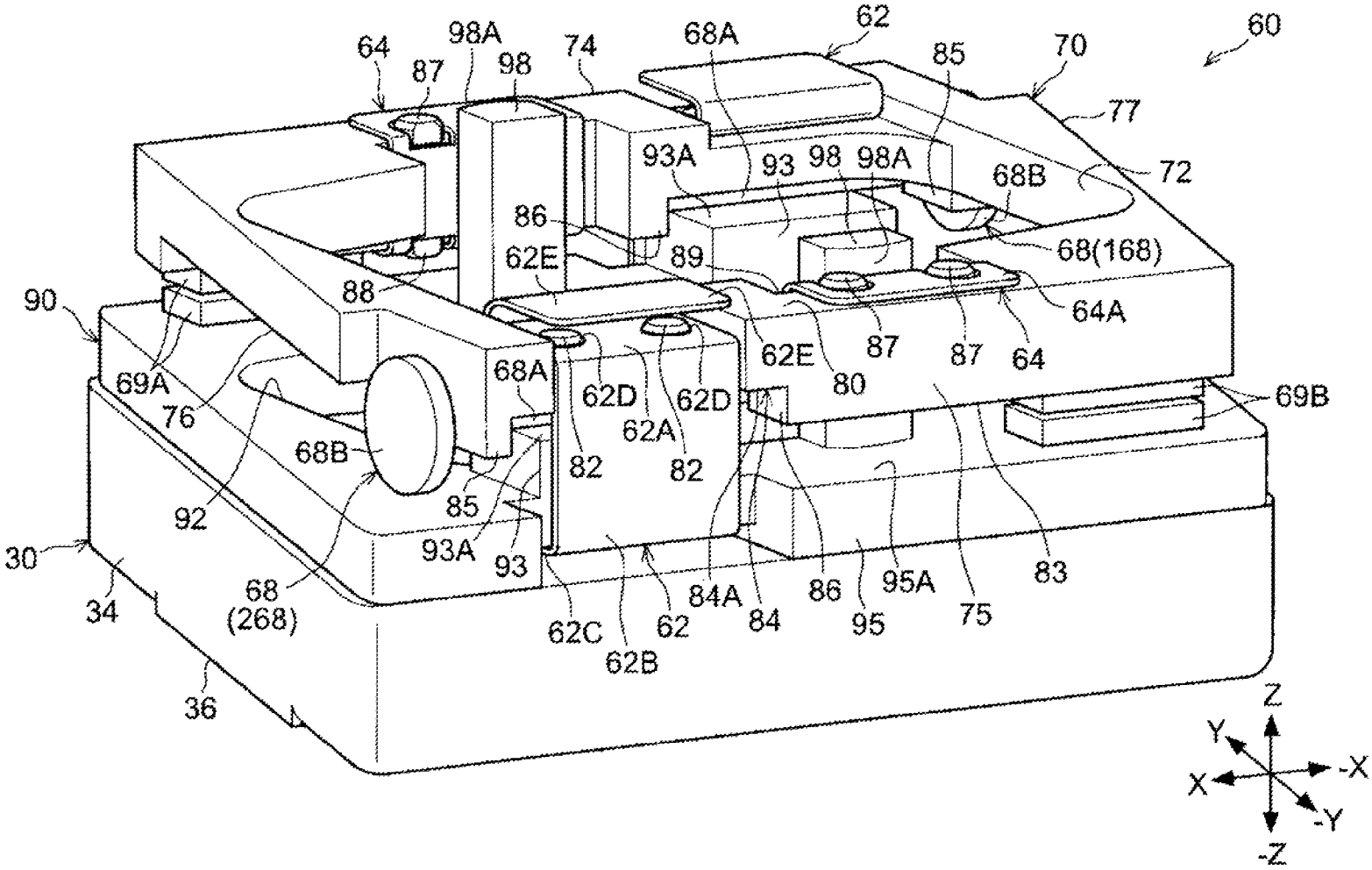
FIG. 8 is a perspective of the structure of each moving mechanism.

As shown in FIG. 8, each moving mechanism 60 has a top frame 70 (example first fixed member), a bottom frame 90 (example second fixed member), a pair of leaf springs 62, a pair of presser plates 64, a pair of compression springs 65 (see FIG. 3), and a pair of linear actuators 68 (example moving members).

(Top Frame 70)

Figure 9:
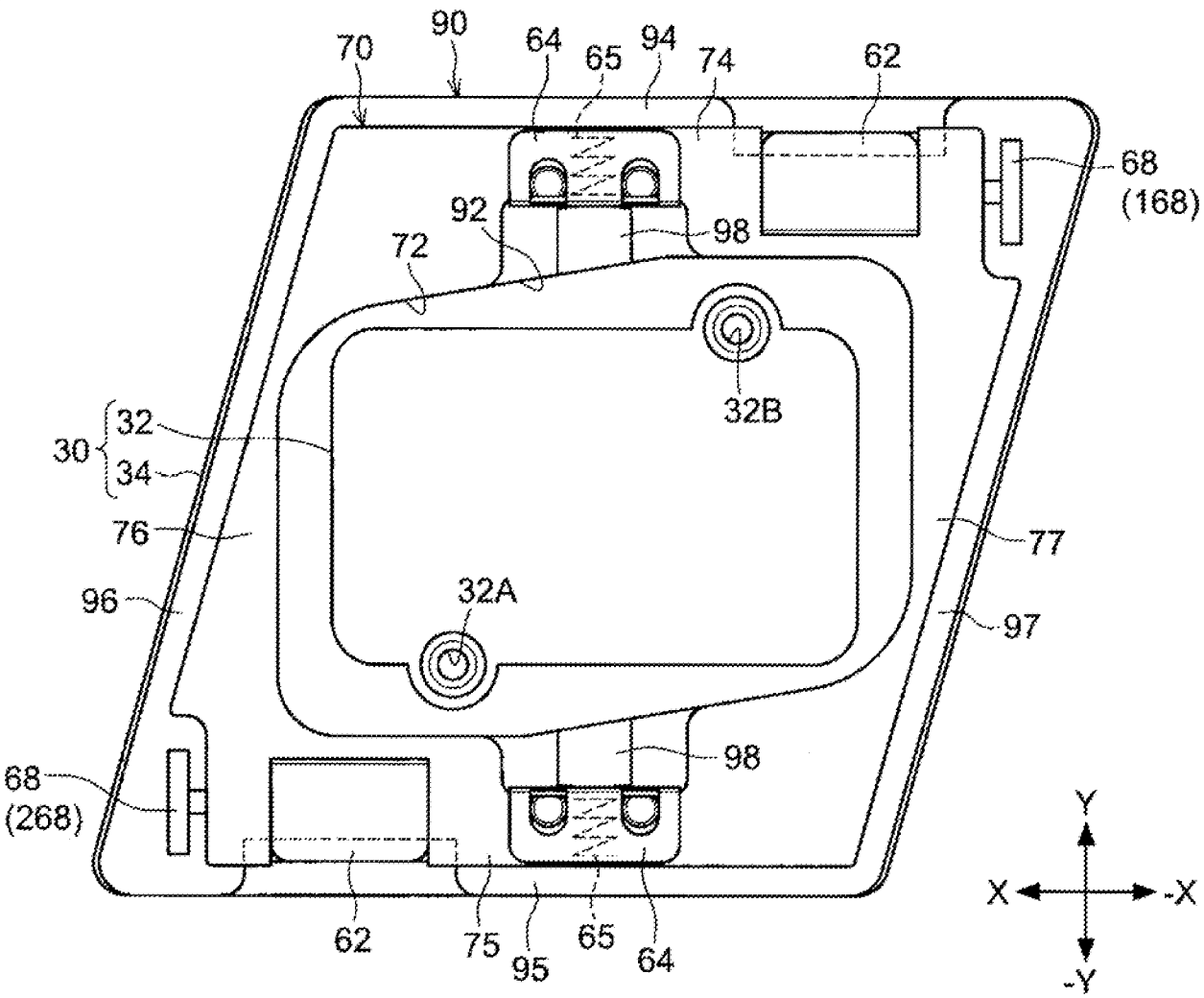
FIG. 9 is another plan view showing the structures of each unit head and the moving mechanism associated with it.

As shown in FIG. 8, the top frame 70 (example first fixed member) is a plate body that is thick in the vertical direction (Z direction) and through which an opening 72 penetrates in the vertical direction. As shown in FIG. 6, the storage unit 32 of the unit head 30 is placed in the opening 72. Therefore, as shown in FIG. 9, in a plan view the top frame 70 is shaped like a frame that surrounds the storage unit 32. In a plan view, the top frame 70 has an approximately parallelogram-like external shape that is one-size smaller than the ejection unit 34.

The top frame 70 is fixed to the quadrangular cylinder 52 (see FIG. 4) of the body 50 by screwing, gluing, or the like. That is, the top frame 70 is fixed to the support unit 23 (see FIG. 2) which has the body 50 and the support member 30.

As shown in FIG. 7, the frame-shaped top frame 70 has a Y-side portion 74 which is long in the X direction and is located downstream of the ejection region R in the Y direction and a −Y-side portion 75 which is long in the X direction and is located downstream of the ejection region R in the −Y direction. Downstream end portions, in the X direction, of the Y-side portion 74 and the −Y-side portion 75 are connected to each other by a link portion 76 and downstream end portions, in the −X direction, of the Y-side portion 74 and the −Y-side portion 75 are connected to each other by a link portion 77.

Figure 10:
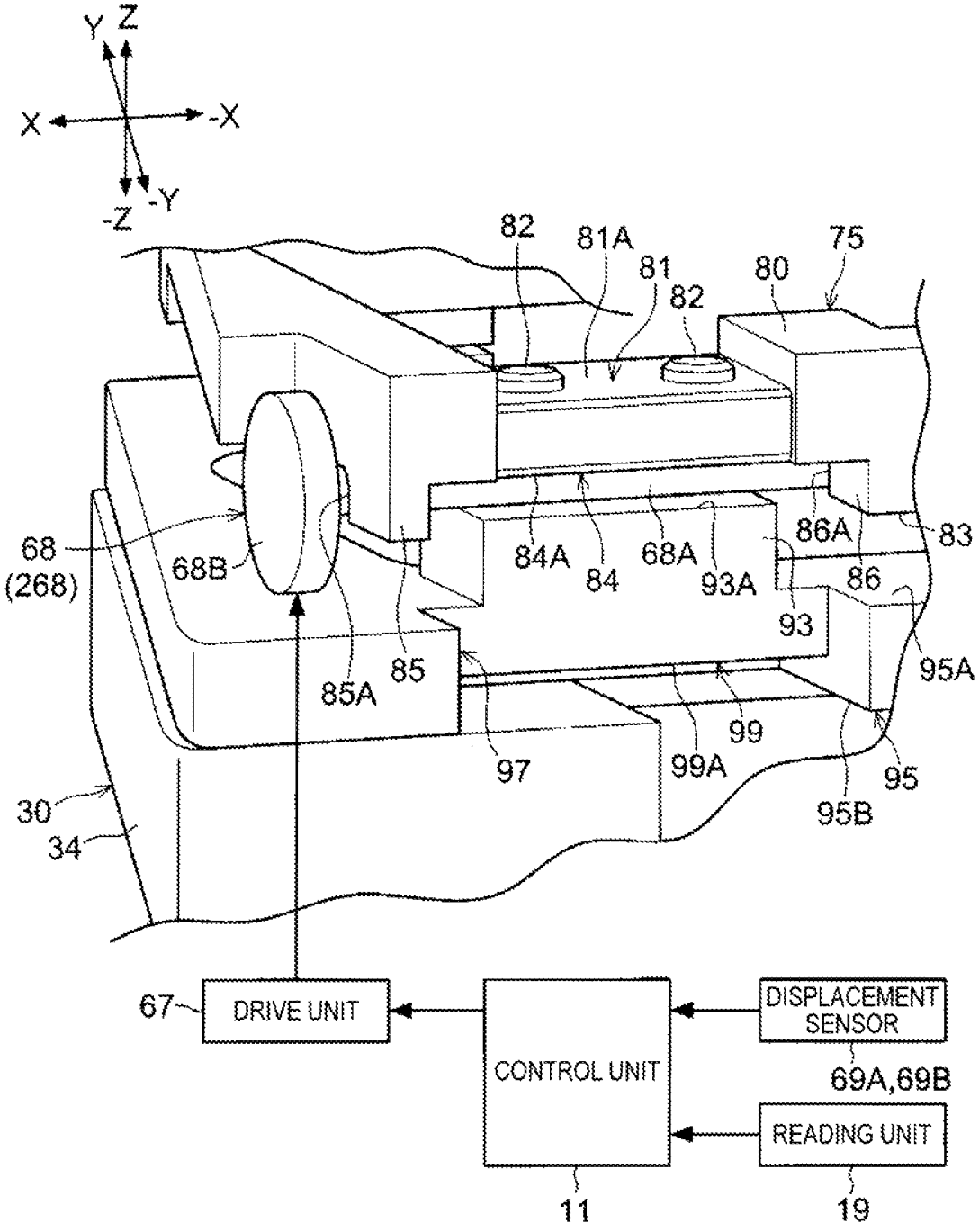
FIG. 10 is a perspective view of a part of each moving mechanism and shows its structure.

As shown in FIG. 10, the −Y-side portion 75 has, as a top portion located downstream in the X direction, a low-level portion 81 whose top surface 81A is lower than a top surface 80 of the −Y-side portion 75. A pair of positioning pins 82 for positioning the associated leaf spring 62 project upward from the top surface 81A of the low-level portion 81.

The −Y-side portion 75 also has, on the back side of (i.e., under) the low-level portion 81, a high-level portion 84 whose top surface 84A is higher than a bottom surface 83 of the −Y-side portion 75. The top surface 84A of the high-level portion 84 serves as a contact surface that is in contact with a shaft 68A of the associated linear actuator 68. The length, in the X direction, of the high-level portion 84 is greater than that of the low-level portion 81. As a result of the formation of the high-level portion 84, projections 85 and 86 which project downward from the level of the top surface 84A of the high-level portion 84 are formed downstream of the high-level portion 84 in the X direction and the −X direction, respectively.

The projections 85 and 86 are formed with respective recesses 85A and 86A which are recessed upward. As described later, the shaft 68A of the associated linear actuator 68 is inserted through or in the recesses 85A and 86A.

Figure 11:
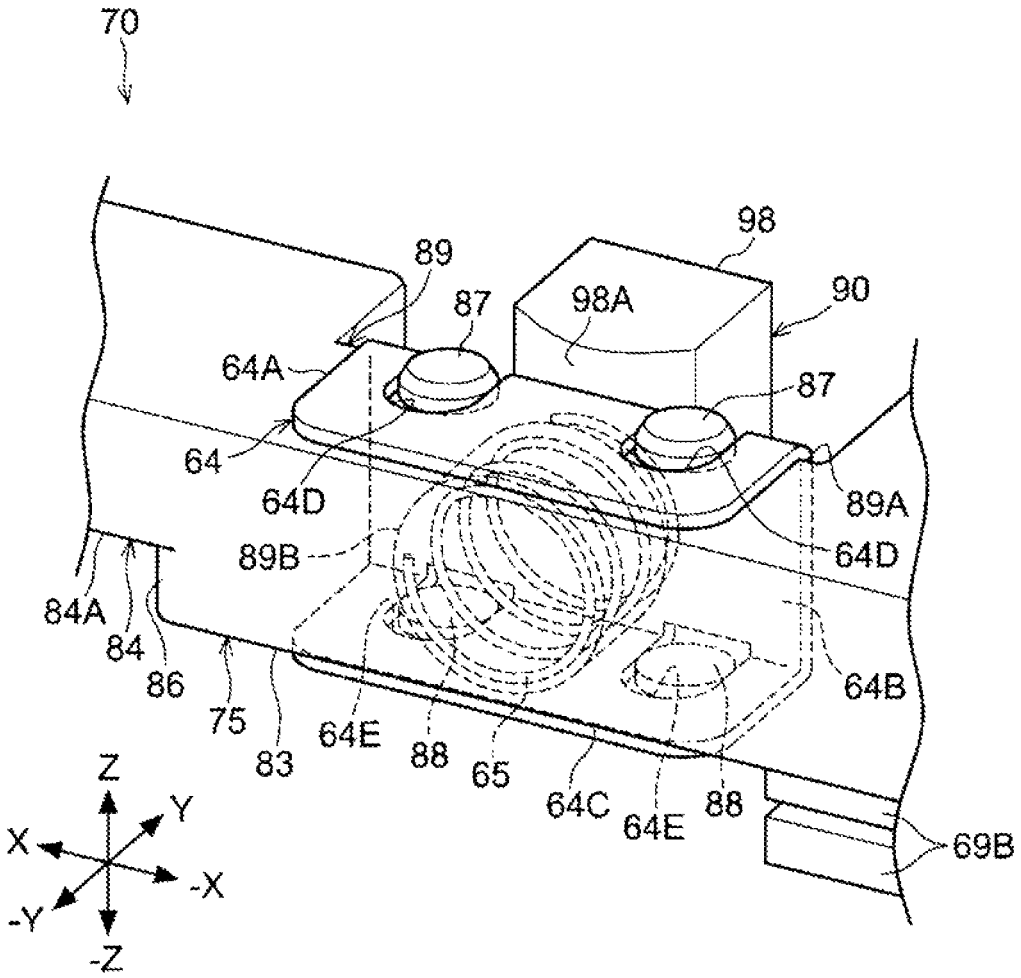
FIG. 11 is a perspective view of another part of each moving mechanism and shows its structure.

As shown in FIG. 8, a pair of positioning pins 87 for positioning the associated presser plate 64 project upward from the top surface 80 of the −Y-side portion 75 at positions downstream of the low-level portion 81 in the −X direction. As shown in FIG. 11, another pair of positioning pins 88 for positioning the presser plate 64 project downward from the bottom surface S3 of the −Y-side portion 75 at positions under the pair of positioning pins 87, respectively.

The −Y-side portion 75 has, downstream of the pair of positioning pins 87, a recess 89 which is recessed in the −Y direction. A Y-side side surface 89A of the recess 89 is formed with a cylindrical recess 898 which houses the associated compression spring 65.

The top frame 70 is rotation-symmetrical with respect to its center axis that extends in the vertical direction so as to coincide with itself when rotated by 180°. That is, the Y-side portion 74 has the same structure as the −Y-side portion 75.

(Bottom Frame 90)

As shown in FIG. 8, the bottom frame 90 (example second fixed member) is a plate body that is thick in the vertical direction (Z direction) and through which an opening 92 penetrates in the vertical direction. As shown in FIG. 6, the storage unit 32 of the unit head 30 is placed in the opening 92. Therefore, as shown in FIG. 9, in a plan view the bottom frame 90 is shaped like a frame that surrounds the storage unit 32. In a plan view, the bottom frame 90 has an approximately parallelogram-like external shape that is slightly smaller in the length in the X direction than the ejection unit 34.

The bottom frame 90 is fixed to the top surface of the ejection unit 34 by screwing, gluing, or the like. That is, the bottom frame 90 is fixed to the unit head 30 which has the unit head 30 which has the ejection unit 34 and the storage unit 32.

As shown in FIG. 7, the frame-shaped bottom frame 90 has a Y-side portion 94 (example first-side portion) which is long in the X direction and is located downstream of the ejection region R in the Y direction and a −Y-side portion 95 (example second-side portion) which is long in the X direction and is located downstream of the ejection region E in the −Y direction. Downstream end portions, in the X direction, of the Y-side portion 94 and the −Y-side portion 95 are connected to each other by a link portion 96 and downstream end portions, in the −X direction, of the Y-side portion 94 and the −Y-side portion 95 are connected to each other by a link portion 97.

As shown in FIG. 10, a top surface 95A of the −Y-side portion 95 is formed, in a region close to its X-side end, with a projection 93 which projects upward. The projection 93 is located under the low-level portion 81 of the −Y-side portion 75 of the top frame 70 and has the same length in the X direction as the latter.

A top surface 93A of the projection 93 is a contact surface that is in contact with the shaft 68A of the associated linear actuator 68. That is, the shaft 68A of the associated linear actuator 68 is sandwiched between the top surface 93A of the projection 93 and the top surface 84A of the associated high-level portion 84 of the top frame 70.

The −Y-side portion 95 of the bottom frame 90 also has, on the back side of (i.e., under) the projection 93, a high-level portion 99 whose top surface is higher than a bottom surface 953 of the −Y-side portion 95. The −Y-side portion 95 of the bottom frame 90 is formed with a recess 97 which is recessed in the Y direction, at a position downstream of the projection 93 in the −Y direction. The length, in the X direction, of the high-level portion 99 is the same as that of the recess 97. The length, in the X direction, of the high-level portion 99 and the recess 97 is greater than that of the projection 93.

Figure 12:
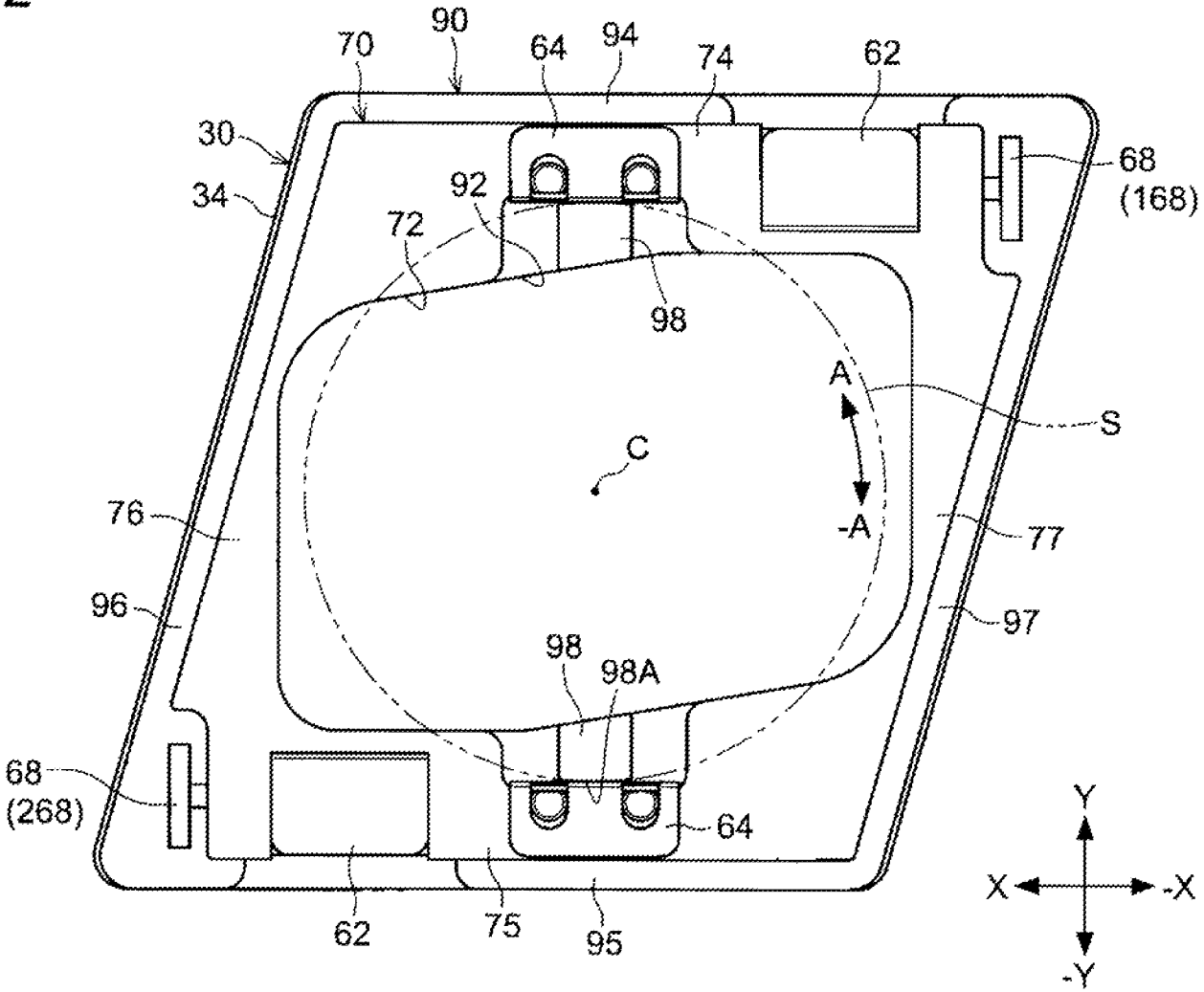
FIG. 12 is still another plan view showing the structures of each unit head and the moving mechanism associated with it.

As shown in FIG. 8, a press subject member 58 against which the presser plate 64 is pressed projects upward from the top surface 95A of the −Y-side portion 95 at a position downstream of the projection 93 in the −X direction. The press subject member 98 is shaped like a rod and is long in the vertical direction. As shown in FIG. 12, in a plan view a −Y-side side surface 98A of the press subject member 98 is a part (i.e., arc) of a circle S (indicated by a two-dot chain line) whose center coincides with the center C of the ejection region R of the unit head 30. For example, the center C of the ejection region R is the intersecting point of the diagonals of the parallelogram-shaped ejection region R (see FIG. 7).

The side surface 98A of the press subject member 98 serves as a guide surface that is in contact with and thereby guides a side plate 64B of the presser plate 64 along the circle S when the unit head 30 is rotated relative to the support unit 23 (described later). That is, the side surface 98A of the press subject member 98 causes the unit head 30 to rotate about the center C of the ejection region R.

The bottom frame 90 is rotation-symmetrical with respect to its center axis that extends in the vertical, direction so as to coincide with itself when rotated by 180°. That is, the Y-side portion 94 has the same structure as the −Y-side portion 95.

(Presser Plate 64 and Compression Spring 65)

As shown in FIG. 9, the two sets of a presser plate 64 and a compression spring 65 are provided for the Y-side portion 74 and the −Y-side portion 75 of the top frame 70, respectively. Since the two sets of a presser plate 64 and a compression spring 65 are configured and arranged in the same manners, only the presser plate 64 and the compression spring 65 that are associated with the −Y-side portion 75 will be described below.

As shown in FIG. 11, the presser plate 64 is bracket-shaped (or U-shaped) in a side view as viewed in the X direction. More specifically, the presser plate 64 has a top plate 64A, a side plate 64B, and a bottom plate 64C.

A pair of insertion holes 64D in which the pair of positioning pins 87 are inserted, respectively, are formed through the top plate 64A. A pair of insertion holes 64E in which the pair of positioning pins 88 are inserted, respectively, are formed through the bottom plate 64C.

The pair of positioning pins 87 are inserted in the pair of insertion holes 64D, respectively, and the pair of positioning pins 88 are inserted in the pair of insertion holes 64E, respectively, whereby the presser plate 64 is positioned in the X direction.

The pair of insertion holes 64B and the pair of insertion holes 64B are long in the Y direction, and hence the presser plate 64 can move in the −Y and Y directions. More specifically, the length, in the Y direction, of the pair of insertion holes 64D and the pair of insertion holes 64E is set so that the side plate 64B of the presser plate 64 can move in a range from a position where it comes into contact with the side surface 89A of the top frame 70 to a position where it conies into contact with the side surface 98A of the press subject member 93 of the bottom frame 90.

The compression spring 65 is a coil spring whose axis extends in the Y direction, and is housed in the cylindrical recess 898 of the −Y-side portion 75 of the top frame 70. Thus, the compression spring 65 presses the side plate 64B of the presser plate 64 against the press subject member 98.

As described above, the pair of presser plates 64 are pressed against the pair of press subject members 98, respectively, whereby the unit head 30 is positioned with respect to the top frame 70 (i.e., support unit 23) in the Y direction.

(Leaf Spring 62)

As shown in FIG. 8, the two leaf springs 62 are provided for the Y-size portion 74 and the −Y-side portion 75 of the top frame 70, respectively. Since the two leaf springs 62 are configured and disposed in the same manners, only the leaf spring 62 that is provided for the −Y-side portion 75 will be described below.

The leaf spring 62 is bracket-shaped (or U-shaped) in a side view as viewed in the X direction. More specifically, the leaf spring 62 has a top plate 62A, a side plate 62B, a bottom plate 62C, and a folded-back portion 62S.

The top plate 62A is placed on the top surface 81A (see FIG. 10) of the low-level portion 81. A pair of insertion holes 62D in which the pair of positioning pins 82 are inserted, respectively, are formed through the top plate 62A. The leaf spring 62 is positioned in both of the X direction and the Y direction because the pair of positioning pins 82 are inserted in the pair of insertion holes 62D.

The folded-back portion 62E is formed by folding back a material plate of the leaf spring 62 at the downstream end, in the Y direction, of the top plate 62A to the −Y direction. The folded-back portion 62E covers the top plate 62A and the pair of positioning pins 82 from above.

The bottom plate 62C is placed on a top surface 99A (see FIG. 10) of the high-level portion 99 of the −Y-side portion 95 of the bottom frame 90. The side plate 62B links the −Y-side end of the top plate 62A and that of the bottom plate 62C at positions downstream of the −Y-side portion 75 of the top frame 70 and the −-Y-side portion 95 of the bottom frame 90 in the −Y direction.

When the leaf spring 62 is in a free state, the interval between a Y-side portion of the top plate 62A and a Y-side portion of the bottom plate 62C is shorter than the distance between the top surface 81A of the low-level portion 81 and the top surface 99A of the high-level portion 99. As a result, the leaf spring 62 nips the top frame 70 and the bottom frame 90 in the vertical direction by means of the top plate 62A and the bottom plate 62C and presses the bottom frame 90 against the top frame 70 via the shaft 68A of the linear actuator 68. Because the bottom frame 90 is pressed against the top frame 70 via the shafts 68A of the linear actuators 68, the unit head 30 which is fixed to the bottom frame 90 is supported by the support unit 23 via the top frame 70.

(Linear Actuator 68)

As shown in FIG. 9, the two linear actuators 68 (example moving members) are provided for the Y-side portion 74 and the −Y-side portion 75 of the top frame 70, respectively. Since the two linear actuators 68 are configured and disposed in the same manners, only the linear actuator 68 that is provided for the −Y-side portion 75 will be described below.

As shown in FIG. 10, the linear actuator 68 has the shaft 68A and a disc-shaped vibrator 68B which is attached to the end, in the axial direction (X direction), of the shaft 68A. As shown in FIG. 7, the length, in the X-direction, of the linear actuator 68 is shorter than that of the ejection region R.

As shown in FIG. 10, a base portion (an end portion in the X direction) and a tip portion (an end portion in the −X direction) of the shaft 68A are fixed to the inner surfaces of the recess 85A of the projection 85 and the recess 86A of the projection 86 by gluing or the like, respectively. Because of the action of the leaf spring 62, the shaft 68A is sandwiched between the top surface 84A of the high-level portion 84 of the −Y-side portion 75 of the top frame 70 and the top surface 93A of the projection 93 of the −Y-side portion 95 of the bottom frame 90 in the region between the projections 85 and 86. Therefore, frictional force occurs between the shaft 68A and the top surface 93A of the projection 93.

For example, the vibrator 68B is a unimorph or bimorph piezoelectric ceramic element. A drive unit 67 is connected to the vibrator 68B. The vibrator 68B is driven by the drive unit. 67, whereby ultrasonic vibration occurs in the vibrator 68B in its axial, direction (−X/X direction).

The linear actuator 68 moves the bottom frame 90 relative to the top frame 70 in the −X or X direction by an impact drive method that utilizes the law of inertia.

More specifically, for example, the linear actuator 68 is vibrated in the −X and X directions so that the shaft 68A is displaced faster in the X direction than in the −X direction. With this driving, first, as the shaft 68A is displaced in the −X direction, the bottom frame 90 is moved in the −X direction due to the frictional force that is exerted from the shaft 68A. When the shaft 68A is thereafter displaced in the X direction, since the displacement speed in the X direction is faster than in the −X direction, the bottom, frame 90 that has been moved in the −X direction is left behind. The phenomenon that the bottom frame 90 is left behind the top frame 70 in the −X direction by a very short distance is caused repeatedly by the vibration in the −X and X direction, whereby the bottom frame 90 is moved relative to the top frame 70 in the −X direction.

For another example, the linear actuator 68 is vibrated in the −X and X directions so that the shaft 68A is displaced faster in the −X direction than in the X direction. With this driving, first, as the shaft 68A is displaced in the X direction, the bottom frame 90 is moved in the X direction due to the frictional force that is exerted from the shaft 68A. When the shaft 68A is thereafter displaced in the −X direction, since the displacement speed in the −X direction is faster than in the X direction, the bottom frame 90 that has been moved in the X direction is left behind. The phenomenon that the bottom frame 90 is left behind the top frame 70 in the X direction by a very short distance is caused repeatedly by the vibration in the −X and X direction, whereby the bottom frame 90 is moved relative to the top frame 70 in the X direction.

(Control Unit 11)

The control unit 11 is connected to the drive units 67 for the linear actuators 68 which are attached to the Y-side portion 74 and the −Y-side portion 75 of the top frame 70, respectively (see FIG. 10). In the following description, the linear actuators 68 that are attached to the Y-side portion 74 and the −Y-side portion 75 will be referred to as a Y-side actuator 168 and a −Y-side actuator 268, respectively.

The control unit 11 drives the drive unit 67 for the Y-side actuator 168 to move the Y-side portion 94 of the bottom frame 90 relative to the top frame 70 in the X or -X direction and drives the drive unit 67 for the −Y-side actuator 268 to move the −Y-side portion 95 of the bottom frame 90 relative to the top frame 70 in the same direction (X or −X direction) by the same distance as the Y-side portion 94 is moved. As a result, the unit head 30 is moved relative to the support unit 23.

By moving the Y-side portion 94 and the −Y-side portion 95 in the same direction (X or −X direction) by different distances, the unit head 30 can be rotated about the center C of the ejection region R as well as moved relative to the support unit 23 in the X or −X direction.

Furthermore, the control unit 11 drives the drive unit 67 for the Y-side actuator 168 to move the Y-side portion 94 of the bottom frame 90 relative to the top frame 70 in the X or −X direction and drives the drive unit 67 for the −Y-side actuator 268 to move the −Y-side portion 95 of the bottom frame 90 relative to the top frame 70 in the opposite direction (−X or X direction; to the movement direction of the Y-side portion 94 by the same distance as the movement distance of the Y-side portion 94. As a result, the unit head 30 is rotated relative to the support unit 23 about the center C of the ejection region R in an A or −A direction.

A displacement sensor 69A for detecting a displacement of the Y-side portion 94 of the bottom frame 90 with respect to the top frame 70 and a displacement sensor 69B for detecting a displacement of the −Y-side portion 95 of the bottom frame 90 with respect to the top frame 70.

With this measure, actual displacements of the Y-side portion 94 and the −Y-side portion 95 are sent from the displacement sensors 69A and 69B to the control unit 11. The control unit 11 adjusts the drive amounts of the Y-side actuator 168 and the −Y-side actuator 268 on the basis of the received actual displacements (feedback control).

As shown in FIG. 8, the displacement sensor 69A is disposed between an X-side end portion of the Y-side portion 74 of the top frame 70 and an X-side end portion of the Y-side portion 94 of the bottom frame 90. And the displacement sensor 69B is disposed between a −X-side end portion of the −Y-side portion 75 of the top frame 70 and a −X-side end portion of the −Y-side portion 35 of the bottom frame 90. The displacement sensors 69A and 69B may be sensors of any of various types such as an optical type and an eddy current type.

A reading unit 19 for reading a test pattern that is formed on the continuous sheet P is also connected to the control unit 11. A reading result (image information of a test pattern) of the reading unit 19 is sent to the control unit 11. The control unit 11 determines a movement distance (correction amount) in the X or −X direction and an angle of rotation (correction amount) about the axis extending in the Y direction of each unit head 30 on the basis of the reading result. The control unit 11 drives the Y-side actuator 168 and the −Y-side actuator 268 for each unit head 30 on the basis of the determined correction amounts and thereby performs position adjustment on the unit head 30.

The control unit 11 performs position adjustment on each unit head 30 in the above-described manner upon acquisition of a position adjustment command to do so. A specific position adjustment operation on each unit head 30 will be described in the following section "workings of exemplary embodiment."

(Workings of Exemplary Embodiment)

In the exemplary embodiment, the control unit 11 acquires a position adjustment command to perform position adjustment on each unit head 30 when an operator has made a manipulation to that effect on a manipulation unit (not shown).

Upon receiving the position adjustment command, the control unit 11 activates the take-up roll 28, the droplets ejection heads 22, and the moving mechanisms 60 (Y-side actuators 168 and −Y-side actuators 268) for the respective unit heads 30.

As a result, ink droplets are ejected from the droplets ejection heads 22 toward the continuous sheet P being fed as a result of taking-up by the take-up roll 28, whereby a test pattern is formed on the continuous sheet P. The test pattern is read by the reading unit 19, and a reading result is sent from the reading unit 19 to the control unit 11. The control unit 11 determines a movement distance (correction amount) in the X or −X direction and an angle of rotation (correction amount) about the axis extending in the Y direction of each unit head 30 on the basis of the reading result.

The control unit 11 drives the Y-side actuator 168 and the −Y-side actuator 268 for each unit head 30 on the basis of the determined correction amounts and thereby performs position adjustment on the unit head 30.

For example, if determined correction amounts show that it is necessary to move a unit head 30 relative to the support unit 23 in the X direction, the control unit 11 drives the drive units 67 for the associated Y-side actuator 168 and −Y-side actuator 268 in the manner described below.

The control unit 11 drives the Y-side actuator 168 to move the Y-side portion 94 of the bottom frame 90 relative to the top frame 70 in the X direction and drives the −Y-side actuator 268 to move the −Y-side portion 95 of the bottom frame 90 relative to the top frame 70 in the X direction by the same distance as the Y-side portion 94 is moved. As a result, the unit head 30 is moved relative to the support unit 23 in the X direction.

For another example, if determined correction amounts show that it is necessary to rotate a unit head 30 relative to the support unit 30 in the A direction (see FIG. 12), the control unit 11 drives the drive units 67 for the associated Y-side actuator 168 and −Y-side actuator 268 in the manner described below.

The control unit 11 drives the Y-side actuator 168 to move the Y-side portion 94 of the bottom frame 90 relative to the top frame 70 in the X direction and drives the −Y-side actuator 268 to move the −Y-side portion 95 of the bottom frame 90 relative to the top frame 70 in the −X direction by the same distance as the movement distance of the Y-side portion 94. As a result, the unit head 30 is rotated relative to the support unit 23 about the center C of the ejection region R in the A direction (see FIG. 12).

For a further example, if determined correction amounts show that it is necessary to move a unit head 30 in the X direction and rotate it in the A direction, the control unit 11 drives the drive units 67 for the associated Y-side actuator 168 and −Y-side actuator 268 in the manner described below.

The control unit 11 drives the Y-side actuator 168 to move the Y-side portion 94 of the bottom frame 90 relative to the top frame 70 in the X direction and drives the −Y-side actuator 268 to move the −Y-side portion 95 of the bottom frame 90 relative to the top frame 70 in the X direction by a shorter distance than the Y-side portion 94 is moved. As a result, the unit head 30 is rotated in the A direction as well as moved relative to the support unit 23 in the X direction.

Actual displacements of the Y-side portion 94 and the −Y-side portion 95 are sent from the displacement sensors 69A and 69B to the control unit 11. The control unit 11 adjusts the drive amounts of the Y-side actuator 168 and the −Y-side actuator 268 on the basis of the received actual displacements (feedback control).

In the exemplary embodiment, position adjustments between the unit heads 30 are made by moving and/or rotating each unit head 30 relative to the support unit 23 in the above-described manner. As a result, variations of the attachment positions (including postures) of the unit heads 30 with respect to the support unit 23 are corrected. Since adjustments can be made between the positions of the unit heads 30 even after their attachment, the accuracy that is required in attaching the unit heads 30 can be relaxed.

Furthermore, in the exemplary embodiment, even if variations have occurred with a lapse of time between the positions of the unit heads 30 (e.g., due to thermal contraction of the support member 40), position adjustments can be made between the unit heads 30 by moving and/or rotating each unit head 30 relative to the support unit 23. This makes it unnecessary to form the support unit 40 using an expensive, low linear expansion material.

As described above, in the exemplary embodiment, each unit head 30 is moved in the X or −X direction and/or rotated about the axis extending in the vertical direction relative to the support unit 23 by moving the Y-side portion 94 and the −Y-side portion 95 of the bottom frame 90 in the X or −X direction by controlling the driving of the Y-side actuator 168 and the −Y-side actuator 268.

As a result, the number of components is made smaller than in a case that a mechanism for moving each unit head 30 in the X or −X direction relative to the support unit 23 and a mechanism for rotating the unit head 30 relative to the support unit 23 are separate mechanisms. The reduction in the number of components makes it possible to simplify the configuration of the image forming apparatus 10 and to reduce its size and production cost.

In the exemplary embodiment, each unit head 30 is rotated relative to the support unit 23 about the center C of its ejection region R (see FIG. 12). Therefore, in adjusting the position in the rotational direction of each unit head 30 by rotating it, the position of the unit head 30 (ejection region R) is less prone to vary in the X direction or the Y direction than in a case that the unit head 30 is rotated about a position that is located outside the ejection region R. As a result, in making, for example, a fine adjustment of the position in the rotational direction of each unit head 30, a control can be made without taking its positions in the X direction and the Y direction into consideration.

In the exemplary embodiment, the length, in the X direction, of the linear actuators 68 is shorter than that of the ejection region R. Therefore, even if unit heads 30 are arranged in series in the X direction, a phenomenon that a linear actuator 68 for one unit head 30 interferes with another unit head 30 is less prone to occur than in a case that the length, in the X direction, of the linear actuators 68 is greater than that of the ejection region R.

In the exemplary embodiment, the linear actuators 68 are sandwiched (disposed) between the top frame 70 and the bottom frame 90 which are shaped like plates that are relatively thick in the vertical direction with the axial direction of the linear actuators 68 extending in the X direction. Therefore, the length of the image forming apparatus 10 in the droplets ejection direction is made shorter than in a case that the linear actuators 68 are sandwiched between a top frame and the bottom frame that are rather thick in the vertical direction. Furthermore, the length of the image forming apparatus 10 in the droplets ejection direction is made shorter than in a case that the linear actuators 68 are sandwiched with their axial directions extending in the vertical direction.

(Modifications)

Although in the exemplary embodiment each unit head 30 is rotated relative to the support unit 23 about the center C of its ejection region R (see FIG. 12), the invention is not limited to such a case; it suffices that the rotation center of each unit head 30 be located within its ejection region R.

Although in the exemplary embodiment the linear actuators 68 are ones driven by the impact drive method the invention is not limited to such a case; actuators that are driven by some other drive method may be employed.

Although in the exemplary embodiment each presser plate 64 is pressed against the press subject member 98 by the compression spring 65, the invention is not limited to such a case. For example, a structure is possible in which each presser plate 64 is a leaf spring and is pressed against the press subject member 98 by its own resilience.

Although in the exemplary embodiment the plural unit heads 30 are arranged in series in the width direction of the continuous sheet P (X direction), the invention is not limited to such a case. For example, a configuration is possible that unit heads 30 are arranged in the X direction in a staggered manner. Furthermore, each droplets ejection head 22 may be a single ejection head.

The invention is not limited to the above exemplary embodiment, and various modifications, changes, and improvements are possible without departing from the spirit and scope of the invention. For example, some of the above-described modifications may be combined as appropriate.

What is claimed is:

1. A droplets ejecting apparatus comprising:

an ejection head that ejects droplets to a predetermined ejection direction toward a recording medium being fed in a predetermined feeding direction;

a support unit that supports the ejection head;

moving members that are provided for a first-side portion and a second-side portion between which an ejection region of the ejection head is interposed in the feeding direction in a view as viewed in the ejection direction, and that move the first-side portion and the second-side portion in a crossing direction that is perpendicular to the ejection direction and the feeding direction; and a control unit that causes the ejection head to move in the crossing direction relative to the support unit by controlling the moving members so as to move the first-side portion and the second-side portion toward a same side in the crossing direction, and causes the ejection head to rotate relative to the support unit about an axis extending in the ejection direction by controlling the moving members so as to move the first-side portion and the second-side portion toward opposite sides in the crossing direction.

2. The droplets ejecting apparatus according to claim 1, wherein the moving members rotate the ejection head about the axis that extends in the ejection direction and is located within the ejection region in a view as viewed in the ejection direction.

3. The droplets ejecting apparatus according to claim 2, wherein a plurality of ejection heads are arranged in the crossing direction, and a length, in the crossing direction, of the moving members is shorter than that of the ejection region.

4. The droplets ejecting apparatus according to claim 3, further comprising:

a plate-like first fixed member that is fixed to the support unit and is thick in the ejection direction; and a plate-like second fixed member that is fixed to the ejection head or each of the ejection heads and is thick in the ejection direction, wherein each of the moving members that are provided for the first-side portion and the second-side portion, respectively, is sandwiched between the first fixed member and the second fixed member in the ejection direction.

5. The droplets ejecting apparatus according to claim 2, further comprising:

a plate-like first fixed member that is fixed to the support unit and is thick in the ejection direction; and a plate-like second fixed member that is fixed to the ejection head or each of the ejection heads and is thick in the ejection direction, wherein each of the moving members that are provided for the first-side portion and the second-side portion, respectively, is sandwiched between the first fixed member and the second fixed member in the ejection direction.

6. The droplets ejecting apparatus according to claim 1, wherein a plurality of ejection heads are arranged in the crossing direction, and a length, in the crossing direction, of the moving members is shorter than that of the ejection region.

7. The droplets ejecting apparatus according to claim 6, further comprising:

a plate-like first fixed member that is fixed to the support unit and is thick in the ejection direction; and a plate-like second fixed member that is fixed to the ejection head or each of the ejection heads and is thick in the ejection direction, wherein each of the moving members that are provided for the first-side portion and the second-side portion, respectively, is sandwiched between the first fixed member and the second fixed member in the ejection direction.

8. The droplets ejecting apparatus according to claim 1, further comprising:

a plate-like first fixed member that is fixed to the support unit and is thick in the ejection direction; and a plate-like second fixed member that is fixed to the ejection head or each of the ejection heads and is thick in the ejection direction, wherein each of the moving members that are provided for the first-side portion and the second-side portion, respectively, is sandwiched between the first fixed member and the second fixed member in the ejection direction.

9. The droplets ejecting apparatus according to claim 1, wherein the first-side portion and the second-side portion are provided at point symmetrical positions about a center of the ejection region.

* * * * *